United States Patent [19]

Bennett

[11] Patent Number: 5,036,916

[45] Date of Patent: Aug. 6, 1991

[54] METHOD AND APPARATUS FOR LOCATING WET CEMENT PLUGS IN OPEN BORE HOLES

[76] Inventor: Frank Bennett, 202, 805-8th Avenue, S.W., Calgary Alberta, Canada, T2P 1H7

[21] Appl. No.: 533,472

[22] Filed: Jun. 5, 1990

[30] Foreign Application Priority Data

Jul. 14, 1989 [CA] Canada ..... 605709

[51] Int. Cl.[5] ..... E21B 33/13; E21B 49/08

[52] U.S. Cl. ..... 166/253; 166/64

[58] Field of Search ..... 166/64, 65.1, 253, 284

[56] References Cited

U.S. PATENT DOCUMENTS 2,231,577 2/1941 Hare ..... 166/253
4,003,431 1/1977 Novotny et al. ..... 166/250
4,043,394 8/1977 Campbell ..... 166/290 X
4,741,201 5/1988 Propst ..... 73/61 R

*Primary Examiner*—William P. Neuder
*Attorney, Agent, or Firm*—Bailey & Hardaway

[57] ABSTRACT

A method and apparatus for locating and determining the quality of a downhole wet cement abandonment plug positioned in an open bore hole. The quality of the plug is detetmined by retrieving a sample of the wet cement mixture to the surface by remotely operating a fluid sampler included as one component in a logging tool. The sample permits the determination of the purity and quality of a downhole wet cement plug, providing valuable information for assessing whether the plug will set properly. Thus the method and apparatus greatly reduces the risk of plug failure due to an inferior cement mixture resulting from the intrusion of contaminants in a wet cement plug.

12 Claims, 5 Drawing Sheets

METHOD AND APPARATUS FOR LOCATING WET CEMENT PLUGS IN OPEN BORE HOLES

The present invention relates to closing abandoned open bore holes, and more specifically to a method and apparatus for determining the location and quality of wet cement plugs in open bore holes.

BACKGROUND OF THE INVENTION

In oil and gas producing areas, government regulations for the abandonment of bore holes require that the different strata of bore holes be permanently isolated by the placement of cement plugs at critical locations in the bore hole. The purpose of the plugs is to prevent the migration of fluids and gases from one strata to another, thereby avoiding contamination of the water table, the escape of hydrocarbons to the atmosphere, etc.

An open hole reference base log is recorded as part of the 'suite' of logs which are recorded when the drilling of a well is completed. The reference base log is a graphic record of the natural gamma radiation of the formations through which the bore hole passes. It provides information about the composition and the location of the strata traversed and serves as a map which is used to determine the number and location of abandonment plugs, as required by government regulations. Abandonment plugs must be positioned in the bore hole in accordance with the depth measurements which are established when the open hole reference base log is created, as this log serves as the standard depth reference for the lifetime of a well.

A typical procedure for the placement of cement plugs in an abandoned bore hole is as follows:

An abandoned bore hole is usually filled with drilling mud, a mixture of water and small sized drilling debris particles, before cement abandonment plugs are placed. A drill pipe is lowered to the estimated location of the bottom of the deepest plug. A logging tool including at least a collar locator and a base log sensor are lowered down the drill pipe to locate the drill pipe in its relation with the formations through which the drill pipe passes. The combination of base log/collar locator log produced on this run is correlated with the open hole reference base log to determine the exact location of the bottom of the drill pipe in the open hole. Any required adjustments to the position of the bottom of the drill pipe are made before a cement abandonment plug is placed in the open hole. A cement abandonment plug is placed in the open hole by cautiously pumping a specific mixture of water and cement down the drill pipe, displacing the drilling mud in the pipe and the bore hole. The densities of the cement mixture and the drilling mud are sufficiently similar that the cement mixture displaces the drilling mud upwardly between the drill pipe and the walls of the bore hole when the cement mixture exits the end of the drill pipe. The quantity of cement mixture pumped into the bore hole is calculated to equal the approximate volume of the required plug and is followed by exactly enough water to fill the drill pipe and completely expel the cement mixture therefrom. The drill pipe is then carefully raised until it is believed to be above the top of the wet plug.

After placement of the wet plug in the bore hole, the location of the top of the plug must be determined to be certain that the plug has the required size. Several methods for locating a cement plug in an abandoned bore hole are known. One method, called tagging, uses the drill pipe string to locate hardened or set plugs by detecting a decrease in the weight of a pipe string lowered onto a hardened plug. The disadvantage of this method is that a period of approximately eight to ten hours must elapse before the plug has hardened sufficiently to support at least part of the weight of the drill pipe, rendering this method very uneconomical. This method is also inaccurate because long drill pipe strings tend to stretch under their own weight, which makes any depth estimates, calculated by adding together the lengths of all the drill pipe sections in the hole, inaccurate by as much as several meters in deep bore holes.

A second method involves the detection of a radioactive tracer added to the whole or to parts of the cement mixture. The tracer in the cement is detected using a gamma ray detector which signals a marked increase in gamma ray readings in the proximity of the plug. The disadvantage of this method is, of course, the handling of dangerous radioactive substances and the introduction of radioactive isotopes into the environment.

Each of the methods described above establish only the location of a plug. A more recently developed method uses a densitometer, a logging tool known in the art which includes a cesium gamma ray source and a flow through sampling port. The Cesium source emits gamma radiation which is directed across the fluid in a flow through sampling port towards a gamma ray detector that measures the amount of radiation passing through the material in the sampling port. The density of a fluid in the sampling port is inversely proportional to the intensity of radiation reaching the gamma ray detector of the densitometer. Thus an increase in the density of a fluid passing through the sampling port causes a corresponding decrease in the intensity of the radiation reaching the gamma ray detector. Consequently a cement mixture, which is more dense than drilling mud, can be detected in a bore hole and an estimate of the purity of the plug can be determined by comparing the density measurement of the pure cement mixture with the density measurement of the downhole plug. Although this method provides an approximation of the purity of a wet cement plug in a bore hole, it does not provide any information about the nature of the contamination in an impure plug.

Abandonment plugs may be contaminated by a variety of substances common in well bores. Possible contaminants include lime, shale, sand, water, limestone, oil and gas. These contaminants may reduce the quality and increase the permeability of a plug by interfering with the setting of the cement, or reducing its strength by producing channels or fissures. Two disadvantages of the densitometer method of assessing the quality of a wet cement plug are that contaminants having a density equal or close to the density of the cement mixture cannot be readily detected, and the type of contamination in a wet cement plug cannot be determined. For instance it is extremely difficult to differentiate between water and oil contamination using density measurements, however their effects on plug quality are quite different. Oil, especially kerosene, is often purposefully added to a cement mixture to retard the setting of the cement and generally does not affect cement quality whereas increasing the water content of a cement mixture progressively reduces cement strength. For instance, a ratio of 40 cement/60 water produces a plug of excellent quality, while a ratio of 10 cement/90 water produces a cement mixture that will not set.

Water inflow and the introduction of drilling mud into a wet cement plug both decrease the quality of the plug. A fluid densitometer measurement cannot necessarily be used to differentiate between water and drilling mud contamination as either in the correct proportion may affect the density of a wet cement mixture to the same extent. The introduction of a certain amount of drilling mud into a wet plug may be perfectly acceptable in respect to plug quality, whereas water in a quantity to equivalently lower the density of the plug may affect the quality of the plug to the extent that it is no longer acceptable. Finally, small quantities of gas infiltration may not be detectable by a densitometer but can lead to seriously lower plug quality. The expansion forces of the gas can permeate the plug with channels, causing leaks and endangering the environment. Gas leaks are usually detected only after the well has been closed. When this occurs an expensive reabandonment process must be followed to correct the situation.

The present invention provides a novel method and apparatus for determining the location and assessing the quality of a wet cement plug, whereby a sample of the plug is captured and retrieved to the surface for examination and analysis.

The probability of poor quality cement plugs may be minimized by taking a downhole cement sample of a new plug. Taking a downhole sample and examining it for contamination, can provide information about all major parameters relating to abandonment plug quality, including: the plug border mixture density, the compressive strength, the setting time, the permeability, and the type and extent of contamination in the area where the sample is taken. Fluid density logging with a gamma ray densitometer can only determine the first and sometimes, by inference, the second of these parameters.

It is an especial advantage of the invention that it provides for the quality control of fully positioned cement abandonment plugs, thereby greatly reducing the risk of plug failure and reabandonment. Examination of a sample of a plug which is indicated by sensing tools to be of questionable density permits a determination of whether the plug will set properly, and thereby is useful in resolving disputes between a government inspector and the owner of a well regarding the quality of a positioned plug.

SUMMARY OF THE INVENTION

In accordance with a preferred embodiment of the invention a logging tool is suspended by a wire line in a drill pipe in a bore hole and is connected to recording and control equipment on the surface by one or more isolated conductors within the wire line. The logging tool preferably includes a gamma ray base log detector and a wet cement plug locator. The recording equipment simultaneously compiles data from the gamma ray base log sensor, the wet cement plug locator, and preferably also a collar locator and plots the data as three separate graphs on a single, depth coded log sheet. The collar locator detects changes in the magnetic field created by the small gap between drill pipe sections and by the end of the drill pipe. The gamma ray base log sensor measures the natural radiation of the strata traversed by the bore hole. Therefore the simultaneous use of a gamma ray base log sensor and a collar locator provides information for determining the exact location of the bottom of a drill pipe in an open hole bore.

The wet cement plug locator is preferably a densitometer. The densitometer measures the density of a fluid passing through its sampling port. A predicted increase in the density measurement indicates that the logging tool has entered a wet cement plug.

After a plug is located, and the logging tool is at least partially submerged in the plug, sampling is accomplished by remotely operating an inlet valve that opens or closes an inlet port to a reservoir chamber within the fluid sampler. While the logging tool is progressively lowered down through a drill pipe, a gamma ray base log is recorded and its correlation with the aforesaid open hole reference base log permits the precise determination of the location of the logging tool at all times. Thus once the densitometer indicates contact with the cement mixture the true location of the wet cement plug can be compared with the location as required by government regulations and as indicated on the open hole reference base log. After a sample of the plug is captured by remote operation of the sampler, the logging tool is retrieved from the bore hole and the sample removed from the sampler for visual inspection and optional examination in a laboratory.

Thus according to the present invention, there is provided a method for determining the quality of a wet cement plug, said method comprising;

locating a wet cement plug in the bore hole; and capturing and retrieving to the surface a downhole sample of said plug.

The present invention further provides a tool for determining the quality of a wet cement plug in a bore hole, comprising:

means for detecting the location of said plug; and means for capturing and retrieving to the surface a downhole sample of said plug.

The invention also relates to a method for placing, locating and determining the quality of wet cement plugs in bore holes, comprising:

lowering a drill pipe into the bore hole to the estimated location of the bottom of a required plug;

lowering a logging tool including at least a base log sensor and a collar locator through said drill pipe to record a base log and a collar locator log;

correlating said base log and said collar locator log with the open hole reference base log to determine the exact location of the bottom of said drill pipe;

correcting the position of the bottom of said drill pipe to conform to the exact location of the bottom of said required plug;

removing said logging tool from said drill pipe;

pumping an estimated volume of a wet cement mixture down said drill pipe to form the required plug in said bore hole;

raising said drill pipe to a position estimated to be above the top of said plug;

lowering a logging tool including at least a wet cement plug locator and a fluid sampler through said pipe and recording at least a cement plug location log;

stopping said logging tool when said wet cement plug locator indicates the entry of said logging tool into said wet cement plug;

taking a sample of said plug by operating said sampler;

removing said logging tool from said drill pipe;

removing said sample from said fluid sampler; and examining said sample to determine the quality of said plug.

BRIEF DESCRIPTION OF THE DRAWINGS

The preferred embodiment of the invention will now be explained by way of example only and with reference to the following drawings wherein.

DETAILED DESCRIPTION OF THE PREFERRED EMBODIMENTS

Figure 1:
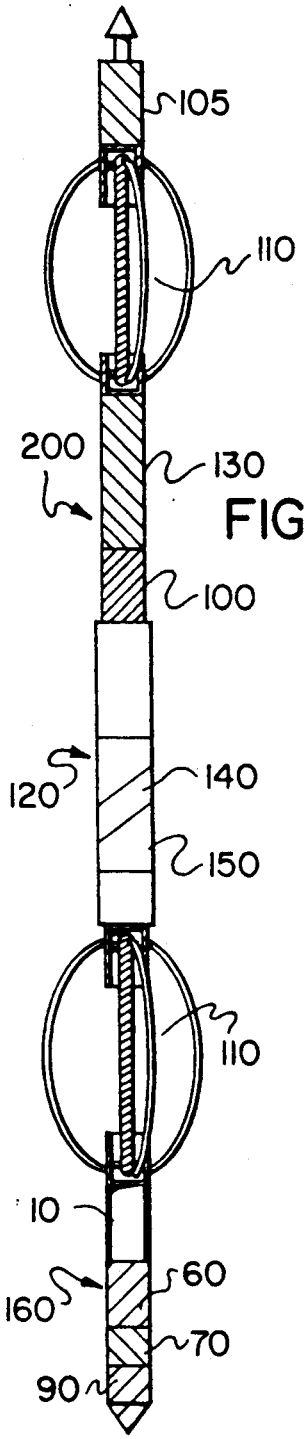
FIG. 1 is a schematic view of a logging tool suitable for practicing the invention.

The present invention relates to a method for locating and sampling of wet cement abandonment plugs and a logging tool for accomplishing same. The preferred logging tool used in the practical application of that method, and generally indicated by reference 200, will be described in detail with reference to FIG. Logging tool 200 includes a cable head 105, a collar locator 100, a gamma ray base log sensor 130, a gamma ray densitometer 120, two bow spring centralizers 110 and a fluid sampler 160. Of course, other wet cement plug locating instruments well known in the art, including mechanical densitometers, acoustic densitometers, temperature sensors and electric resistivity meters, can be used in combination with a fluid sampler in accordance with the invention. However, the use of a gamma ray densitometer with a flow through sampling port for locating wet cement plugs is preferred. The densitometer 120 includes a flow through sampling port 140 and a cesium gamma ray source 150. The fluid sampler 160 includes an inlet valve 10, a reservoir sleeve 60, a pressure release valve sub 70 and a bull nose cap 90.

Figure 2:
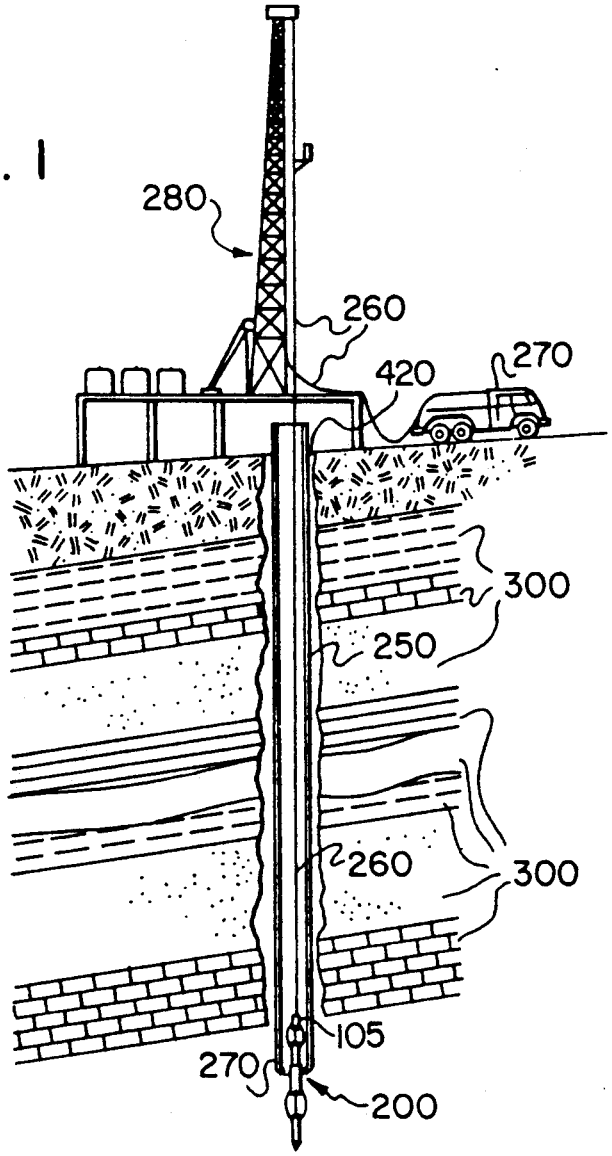
FIG. 2 is a longitudinal cross-sectional view of the fluid sampler portion of the logging tool shown in FIG. 1.

FIG. 2 shows a schematic view of the arrangement used for suspending the logging tool 200 in a drill pipe 250. The logging tool 200 is suspended by a wire line 260 which is electrically connected on one end to a cable head 105, and on the opposite end to recording equipment (see FIG. 6), well known in the art. Wire line 250 is also mechanically connected to cable head 105 and to the sheaves and drums of a standard drilling rig 280 for raising and lowering the logging tool 200 in the drill pipe 250. The wire line 260 is generally stored and transported to the well site in a vehicle 270 which also houses the required data recording equipment.

The method for locating and determining the quality of wet cement abandonment plugs will now be described with reference to FIGS. 1 to 5. Drill tubing 250 is lowered in the open hole 420 until its lower end 270 (FIG. 3) is at the approximate location of the bottom of the lowest required plug. The required location of the plug is determined from the open hole reference base log and the location of the lower end 270 of drill pipe 250 is estimated from the number of drill pipe sections lowered into the bore hole 420. Logging tool 200, attached to wire line 260 by cable head 105, is lowered into drill pipe 250 until the lower end 270 of pipe 250, which corresponds to the last deflection 390 on collar log B (FIG. 4). is detected by collar locator 100. The depth measurement from the reference base log, base log A in FIG. 4, and deflection 390 indicates the exact location of the lower end 270 of the drill pipe 250. Any required adjustments to the position of the bottom end 270 of drill pipe 250 can now be carried out by raising or lowering the drill pipe until it is properly positioned for the placement of the cement plug. Logging tool 200 is then removed from drill pipe 250 and a quantity of water/cement mixture equal to the estimated volume of the required plug is pumped down the drill pipe 250. After completion of the pumping operation, the drill pipe is raised to a position estimated to be above the top of the wet cement plug 320 (see FIG. 5). Logging tool 200 is then lowered into the drill pipe 250 while operating the gamma ray base log detector 130, a collar locator 100 and a gamma ray densitometer 120 to record simultaneously the base log A, a collar locator log B and a density log C (FIG. 4).

Figure 3:
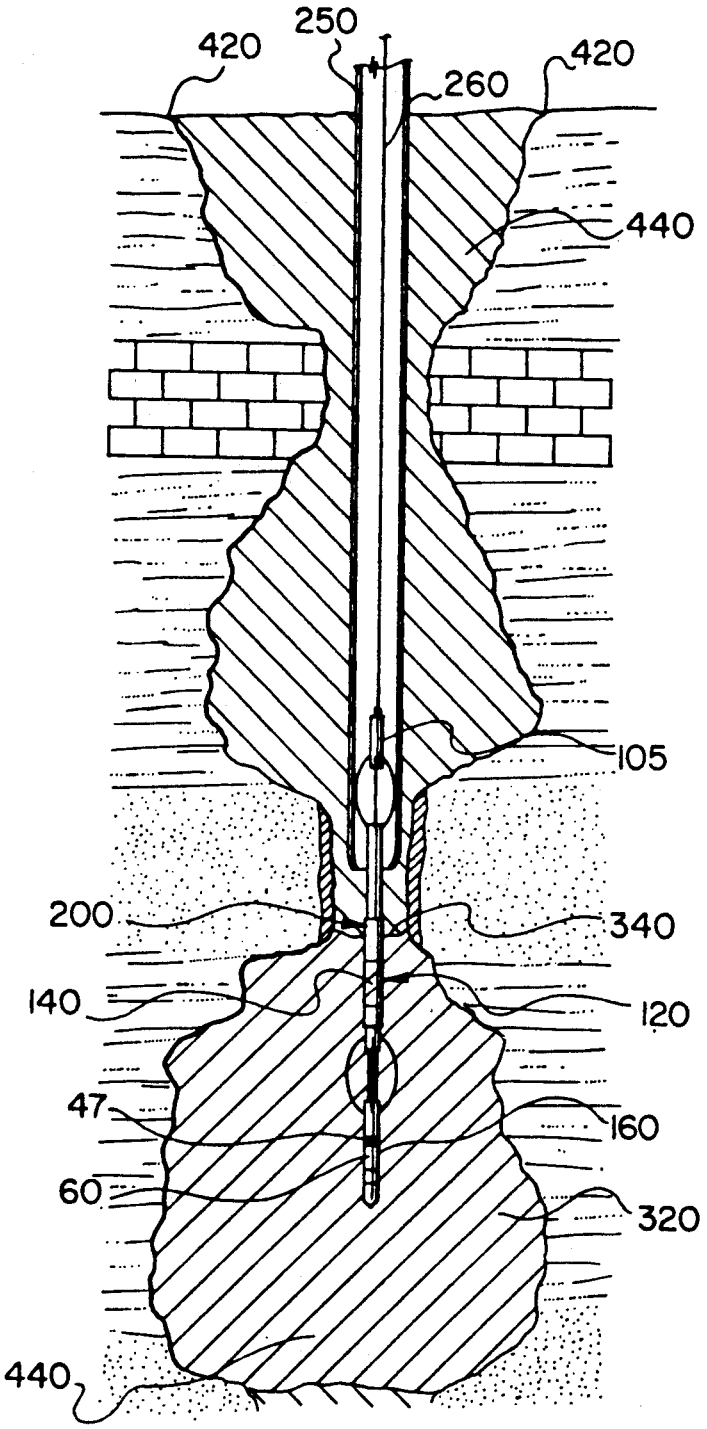
FIG. 3 is a schematic view of the logging tool shown in FIG. 1 suspended by a wire line in s bore hole.
Figure 4:
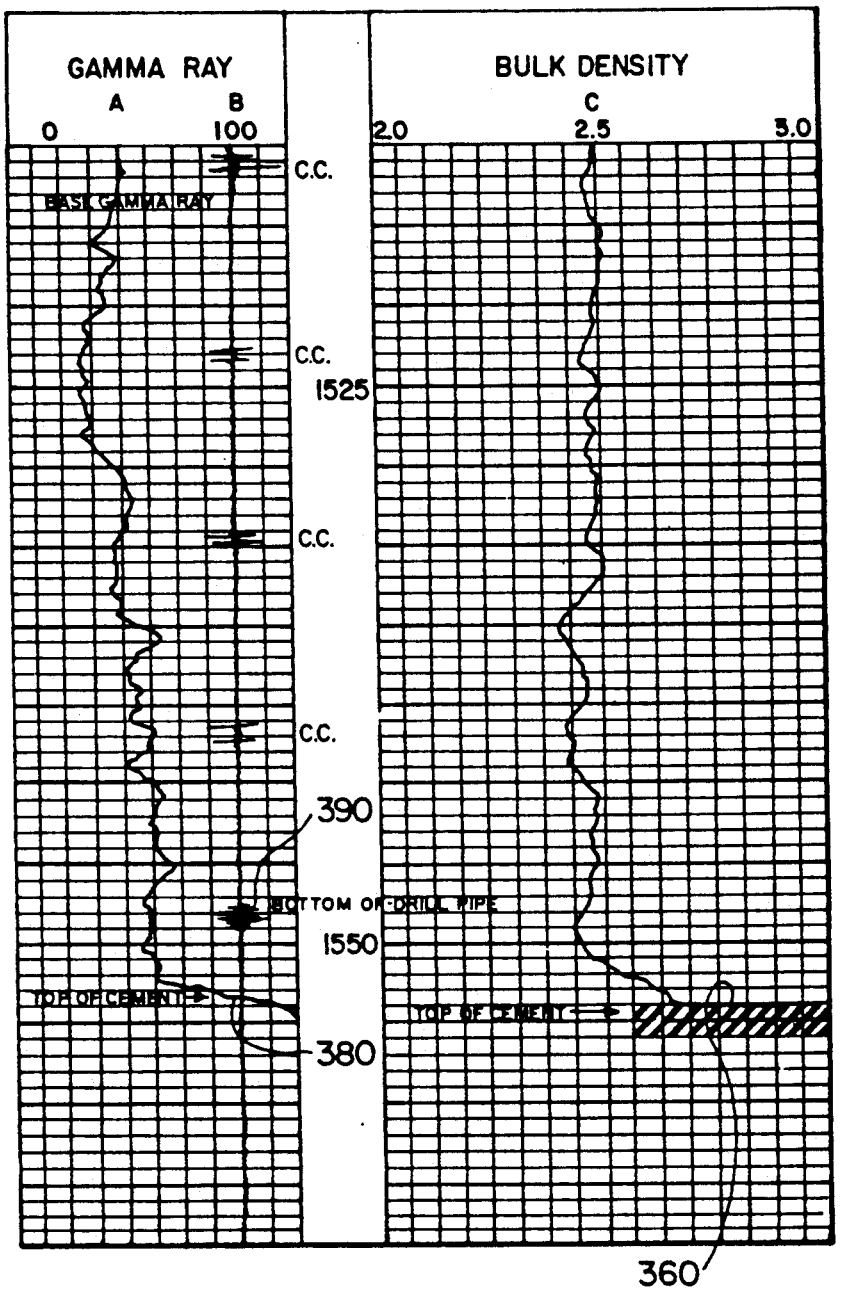
FIG. 4 shows a depth coded log sheet with recordings of a base log, a density log and a collar locator log.

As shown in FIG. 3, the logging tool 200 is lowered until a gamma ray densitometer 120 signals an increase in the density of the fluid in sampling port 140, indicating the immersion of densitometer 130 in the top 340 of vet cement plug 320. Correlation of the base log A with the original open hole reference base log permits the determination of the location of the top 340 of the wet cement plug 320. A sample of cement plug 320 is taken by operating the fluid sampler 160 which opens the sample chamber 62 (FIG. 5) inside reservoir sleeve 60 to the cement mixture of the plug 320. Subsequent sealing of sample chamber 62 from inlet port 47 retains the sample in the chamber. The logging tool 200 is then retrieved to the surface using wire line 260 and the sample is removed from the sampler 160. Examination of the sample reveals the type and extent of contamination, if any, of the vet cement plug at the point of sampling and permits an assessment of the quality of the placed wet cement plug 320.

Figure 5:
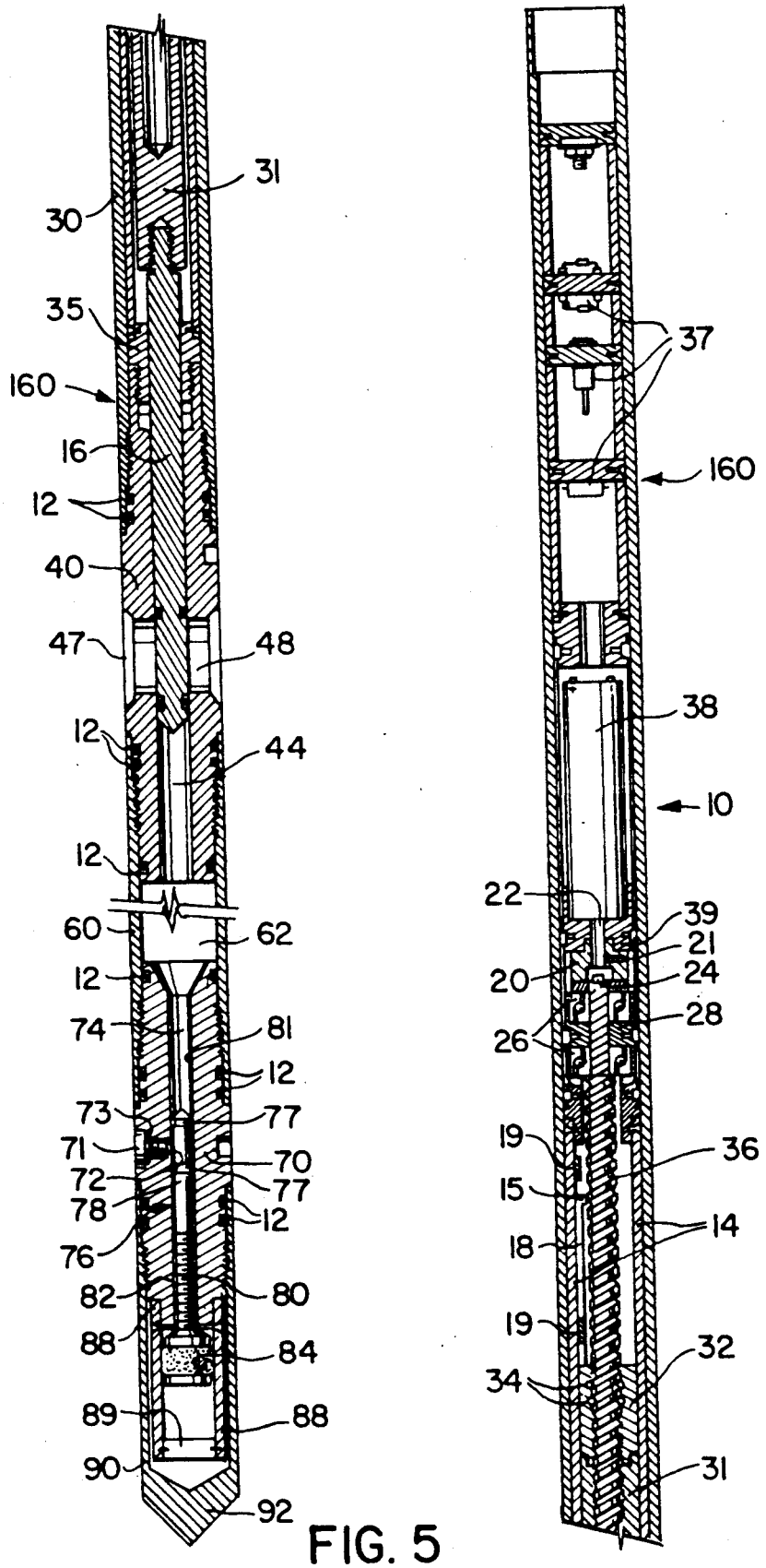
FIG. 5 is a schematic view of the logging tool shown in FIG. 1 partially submerged in a wet cement plug.

Turning now to a detailed description of sampler 160, shown in cross section in FIG. 5, the inlet valve portion of the sampler, generally indicated by reference 10, includes an upper sleeve 30 threadedly engaged with an entry port subassembly 40, a pressure release valve subassembly 70 threadedly interconnected with inlet valve portion 10 by a reservoir sleeve 60 and a bull nose cap 90 which is threadedly attached to pressure release valve subassembly 70. Multiple O-rings 12 seal the threaded connections between upper sleeve 30 and the entry port subassembly 40, entry port subassembly 40 and reservoir sleeve 60, pressure release valve subassembly 70 and reservoir sleeve 60 and between bull nose cap 90 and pressure release valve subassembly 70 from intrusion of foreign matter. The cylindrical entry port subassembly 40 is provided with an inlet bore 48 radially connected with a continuous, axial upper bore 44 downwardly communicating with sample chamber 62 which is located within reservoir sleeve 60. Slide valve piston 16 is axially slidable within upper bore 44. Downward displacement of piston 16 disrupts communication of inlet bore 48 and upper bore 44 closing sample chamber 62 to the medium surrounding the fluid sampler 160. In the closed position of slide valve piston 16 as shown in FIG. 5, O-rings 13 seal the upper bore 44 from the inlet bore 48 preventing the intrusion of matter into sample chamber 62. The cylindrical upper sleeve 30 provides a ball nut 32 engaged by balls 34 with a ball screw 36. Ball nut 32 is axially displaceable but rotationally restrained within upper sleeve 30 and is rigidly connected to a plunger 31 which is threadedly engaged with piston 16. Thus, rotation of ball screw 36 translates into axial displacement of piston 16. Upper sleeve 30 further houses an electric motor 38 restrained by a motor mount 39 and a driving dog 20 affixed to the motor shaft 22 by set screw 21. Driven dog 24 is mounted to ball screw 36 and lockingly interacts with driving dog 20. A set of two ball bearings 26 located in bearing mount 28 supports the ball screw 36 adjacent the motor 38. Ball nut 32 is slidably guided in the upper sleeve 30 by a pair of axially extending rails 14 which are connected on their top ends to bearing mount 28 and on their bottom ends to an adapter mount 35, which is threadedly engaged with entry port subassembly 40. Thus, rotation of motor 38 turns ball screw 36 which results in axial displacement of piston 16 in upper bore 44 selectively opening or closing inlet port 47 to sample chamber 62. A substantially L-shaped switching rod 18 is rigidly affixed to ball nut 32 and extends upwardly therefrom parallel to rails 14. The shorter side 15 of rod 18 operates two motor controlling microswitches 19 attached to the inside of one of guide rails 14. Microswitches 19 are located at the perspective end points of the movement of switching rod 18, which correspond to the open and closed positions of slide valve piston 16.

Pressure release valve subassembly 70 provides a radial pressure release bore 72 and an axial release valve bore 74 which completely traverses pressure release valve subassembly 70 and communicates with both sample chamber 62 and pressure release bore 72. Seal screw 71 is threadedly engaged with pressure release bore 72 selectively closing the latter. O-ring 73 seals the engagement of seal screw 71 and pressure release valve subassembly 70, preventing the intrusion of foreign matter through release valve bore 74 into sample chamber 62. Release valve screw 76 having a screw section 80 and a valve section 78 extends upwardly into release valve bore 74. In its closed position as shown in FIG. 5 the release valve screw 76 extends across the junction area of radial bore 72 with release valve bore 74 closing sample chamber 62. O-rings 77 on valve section 78 of pressure release valve screw 76 form a seal between valve section 78 and release valve bore 74. Valve screw 76 is provided on its lower end with a thumb screw head 84. Two axially extending rods 88 are rigidly affixed on their upper ends to the bottom of pressure release valve subassembly 70 and linked on their lower ends by cross-member 89. This provides a stop for the movement of valve screw 76 to prevent its removal from release valve bore 74.

A sample of a wet cement abandonment plug may be taken by lowering the fluid sampler 160 into a wet cement plug and activating electric motor 38 to turn in a clockwise direction by remote operation of control electronics 37. This moves piston 16 upwardly and opens inlet port 47, allowing the hydrostatic pressure in the wet cement plug to force an influx of cement from the wet plug into sample chamber 62. Counterclockwise rotation of electric motor 38 blocks inlet port 47 and retains the sample completely sealed from the intrusion of foreign matter.

Removing a sample from sampler 160 is accomplished by first releasing the hydrostatic pressure in sample chamber 62, which is due to the downhole pressure where the sample was taken. The pressure in the sampling chamber is released by cycling the fluid sampler to open the sampling port 48 or, alternatively, by manually rotating valve screw 82 to open pressure release bore 72. Once the pressure in the sampling chamber is released, pressure release valve subassembly 70 is separated from reservoir sleeve 60 by counterclockwise rotation of release valve element 70. After the sampling chamber 62 is emptied, it is cleaned with water and lubricated before reassembly. Following the reassembly of the sampling tool, a new sample can be taken. A bullnose cap 90 having a reinforced conical-tip 92 is threadedly engaged with pressure release valve subassembly 70. Bull nose cap 90 provides protection for fluid sampler 160 when it is penetrating into the drilling mud 440 within drill pipe 250 (FIG. 3) and it permits easy access to release valve screw 76 for releasing the pressure in sample chamber 62.

Figure 6:
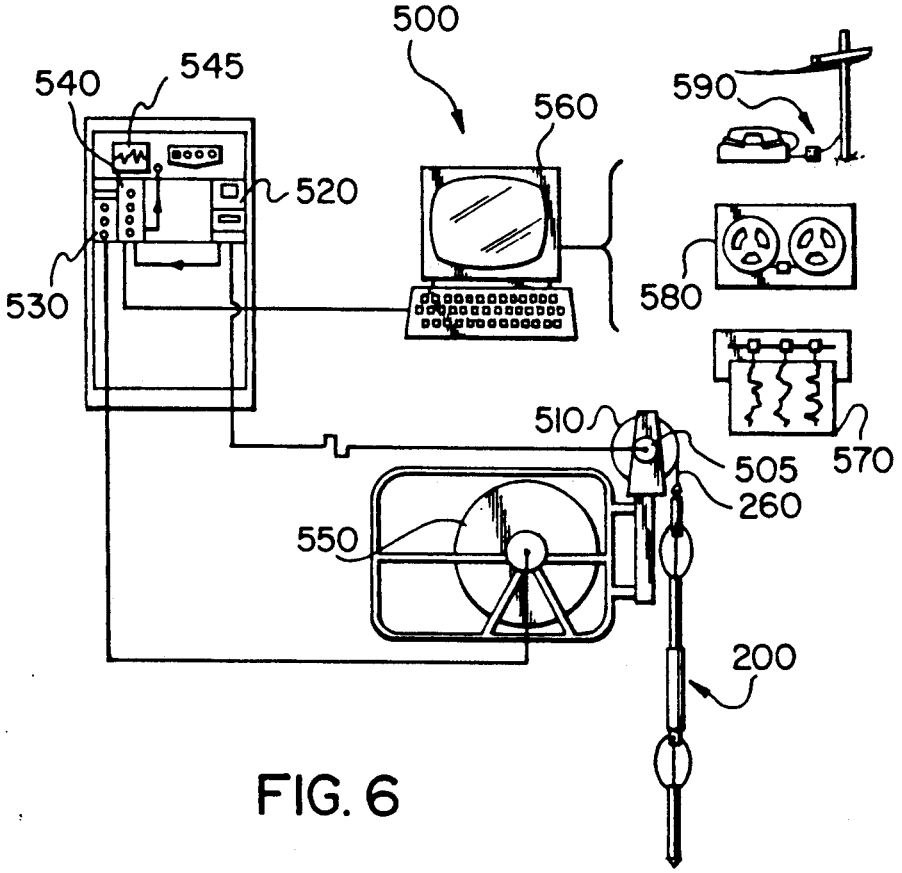
FIG. 6 is a schematic view of recording equipment suitable for practicing the invention.

The recording equipment 500 as shown in FIG. 6 includes a depth encoder 505 located at the wire line pulley 510 and electrically connected to depth counter module 520, a wire line power module 530, a communication module 540 electrically connected to wire line 260 on wire line storage drum 550, a processing module 560 electrically connected to communication module 540, a depth counter module 520, a three track plotter 570, an eight track tape recorder 580, a telecommunication module 590 and an acoustic camera display 545. Depth counter module 520 provides signals to correlate the paper feed of plotter 570 to the location of logging tool 200 in a bore hole.

Changes and modifications in the specifically described embodiments can be carried out without departing from the scope of the invention which is intended to be limited only by the scope of the appended claims.

I claim:

1. A method for determining the quality of a wet cement plug in a bore hole, said method comprising:

providing a tool for determining the quality of a wet cement plug in a bore hole, said tool comprising means for detecting the location of said plug and means for capturing and retrieving to the surface a downhole sample of said plug;

locating a wet cement plug in the bore hole with said tool;

capturing and retrieving to the surface a downhole sample of said plug with said tool; and examining said sample to determine the quality of said plug.

2. A tool for retrieving a sample of a wet cement plug in a bore hole, said tool comprising:

means for detecting the location of said plug; and means for capturing and retrieving to the surface a downhole sample of said plug.

3. A tool as defined in claim 2 comprising in combination:

a collar locator;

a base log sensor;

a densitometer; and a fluid sampler.

4. A method for determining the quality of a wet cement plug in a bore hole, comprising:

lowering a logging tool including at least a wet cement plug locator and a fluid sampler into said bore hole;

stopping said logging tool when said wet cement plug locator indicates that said sampler is within said wet cement plug;

obtaining a sample of said plug by operating said fluid sampler;

removing said logging tool from said bore hole;

removing said sample from said fluid sampler; and examining said sample to determine the quality of said plug.

5. A method for positioning a wet cement plug and assessing its quality after placement in a bore hole, comprising:

lowering a logging tool including at least a base log sensor and a collar locator through said drill pipe to record a base log and a collar locator log;

correlating said base log and said collar locator log with an open hole reference base log to determine the exact location of the bottom of said drill pipe;

correcting the position of the bottom of said drill pipe to conform to the exact location of the bottom of said required plug;

removing said logging tool from said drill pipe;

pumping an estimated volume of a wet cement mixture down said drill pipe to form the required plug in said bore hole;

raising said drill pipe to a position estimated to be above the top of said plug;

lowering a logging tool including at least a wet cement plug locator and a fluid sampler through said pipe and recording at least a cement plug location log;

stopping said logging tool when said wet cement plug locator indicates that said sampler is within said wet cement plug taking a sample of said plug by operating said sampler;

removing said logging tool from said drill pipe;

removing said sample from said fluid sampler; and examining said sample to determine the quality of said plug.

6. A logging tool as defined in claims 2 or 3, further including one or more centralizers for guiding said tool into and through said drill pipe.

7. A logging tool as defined in claims 2 or 3, further including a cable head for attaching said logging tool to a wire line for vertically displacing said tool within a bore hole.

8. A logging tool as defined in claim 3, wherein said fluid sampler comprises:

a sample chamber;

valve means for selectively opening and closing an inlet port to said sample chamber;

means for draining said sample chamber; and means for preventing the intrusion of foreign matter into said sample chamber when said valve means and said drain means are closed.

9. A fluid sampler as defined in claim 8, wherein said valve means for opening and closing said sample chamber comprises:

an inlet valve portion including an upper sleeve and an entry port subassembly;

said entry port subassembly having a continuous axial upper bore communicating with said sample chamber and a radial inlet bore;

a slide valve piston axially displaceable in said upper bore for opening and closing said sample chamber to said inlet bore; and means for driving said piston.

10. A fluid sampler as defined in claim 9, wherein said means for driving said piston comprises:

a ball nut affixed to said piston;

said ball nut being axially slidable in said upper sleeve and engaged with a ball screw;

said ball screw being rotatable by a motor, the rotation of said motor causing axial displacement of said piston; and means for selectively operating said motor.

11. A fluid sampler as defined in claim 8, wherein said means for draining said sample comprises:

pressure release valve means removably connected to said sample chamber and including a pressure release valve subassembly having a radial pressure release bore which communicates with said sample chamber via an axial release valve bore, a release valve screw axially displaceable in said release valve bore for selectively opening and closing said pressure release bore, the displacement of said release valve screw being effected by rotation of said release valve screw which is threadedly engaged in the lower region of said release valve bore, and O-rings for sealing between a valve section of said release valve screw and said release valve bore to prevent the intrusion of foreign matter into said sample chamber.

12. A logging tool as defined in claim 3 electrically connected by one or more conductors within a wire line to recording equipment on the ground surface for recordal of the signals generated by said logging tool.

* * * * *